US010443882B2

(12) United States Patent
Horie et al.

(10) Patent No.: US 10,443,882 B2
(45) Date of Patent: Oct. 15, 2019

(54) OUTSIDE-AIR PROCESSING DEVICE AND AIR-CONDITIONING APPARATUS

(71) Applicant: Mitsubishi Electric Corporation, Tokyo (JP)

(72) Inventors: Hayato Horie, Tokyo (JP); Mamoru Hamada, Tokyo (JP); Masaki Toyoshima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 110 days.

(21) Appl. No.: 15/307,907

(22) PCT Filed: May 14, 2014

(86) PCT No.: PCT/JP2014/062832
§ 371 (c)(1),
(2) Date: Oct. 31, 2016

(87) PCT Pub. No.: WO2015/173909
PCT Pub. Date: Nov. 19, 2015

(65) Prior Publication Data

US 2017/0051940 A1 Feb. 23, 2017

(51) Int. Cl.
*F24F 12/00* (2006.01)
*F24F 11/30* (2018.01)
(Continued)

(52) U.S. Cl.
CPC ..... *F24F 12/006* (2013.01); *F24F 1/0003* (2013.01); *F24F 1/0007* (2013.01);
(Continued)

(58) Field of Classification Search
None
See application file for complete search history.

(56) References Cited

U.S. PATENT DOCUMENTS 4,841,733 A * 6/1989 Dussault ..... F24F 5/0071 62/93
8,151,578 B1 * 4/2012 Morales ..... F24F 3/0442 62/259.2
(Continued)

FOREIGN PATENT DOCUMENTS

JP S61-197932 A 9/1986
JP S63-217155 A 9/1988
(Continued)

OTHER PUBLICATIONS

Machine Translation of JP61-197932A.*
(Continued)

*Primary Examiner* — Jonathan Bradford
(74) *Attorney, Agent, or Firm* — Posz Law Group, PLC

(57) ABSTRACT

An outside-air processing device includes a main body having a return-air introducing port for introducing return air from a room and a supply-air outlet port for blowing out supply air into the room, a total heat exchanger arranged in the main body and configured to exchange heat between outdoor air and the return air, and to blow out the heat-exchanged outdoor air from the supply-air outlet port as the supply air, and an opening-closing unit configured to open and close a bypass path formed in the main body to bypass between the return-air introducing port and the supply-air outlet port.

11 Claims, 5 Drawing Sheets

(51) Int. Cl.

| | |
|---|---|
| ***F24F 11/62*** | (2018.01) |
| ***F24F 3/00*** | (2006.01) |
| ***F24F 1/0003*** | (2019.01) |
| ***F24F 1/0007*** | (2019.01) |
| ***F24F 11/00*** | (2018.01) |
| *F24F 120/10* | (2018.01) |

(52) U.S. Cl.

CPC ..... *F24F 3/001* (2013.01); *F24F 11/0001* (2013.01); *F24F 11/30* (2018.01); *F24F 11/62* (2018.01); *F24F 2011/0002* (2013.01); *F24F 2012/007* (2013.01); *F24F 2120/10* (2018.01); *F24F 2221/14* (2013.01)

(56) References Cited

U.S. PATENT DOCUMENTS

2012/0052791 A1* 3/2012 Kurelowech ..... F24F 11/0017 454/329

2015/0211777 A1* 7/2015 Thomas ..... F24F 1/0007 62/89

FOREIGN PATENT DOCUMENTS

| | | | |
|---|---|---|---|
| JP | H01-141240 | A | 6/1989 |
| JP | H03-286942 | A | 12/1991 |
| JP | H04-023943 | U | 2/1992 |
| JP | H11-051456 | A | 2/1999 |

OTHER PUBLICATIONS

Machine Translation and Original Application of JP04-023943U1.*
Office Action dated Jul. 4, 2017 issued in corresponding JP patent application No. 2016-519035 (and English translation).
International Search Report of the International Searching Authority dated Aug. 19, 2014 for the corresponding International application No. PCT/JP2014/062832 (and English translation).

* cited by examiner

OUTSIDE-AIR PROCESSING DEVICE AND AIR-CONDITIONING APPARATUS

CROSS REFERENCE TO RELATED APPLICATION

This application is a U.S. national stage application of PCT/JP2014/062832 filed on May 14, 2014, the contents of which are incorporated herein by reference.

TECHNICAL FIELD

The present invention relates to an outside-air processing device including a total heat exchanger, and to an air-conditioning apparatus including the outside-air processing device.

BACKGROUND ART

A conventionally known outside-air processing device includes an outside-air processing heat exchanger (direct expansion coil) connected to an indoor unit and an outdoor unit of an air-conditioning apparatus. In this outside-air processing device, air that passes through the outside-air processing heat exchanger to be blown out into a room as supply air is cooled by the indoor unit and the outdoor unit. Consequently, the temperature of the supply air tends to decrease, and thus the comfort of residents inside the room may be significantly deteriorated.

To solve this problem, an outside-air processing device configured to reheat the supply air to be blown out from the outside-air processing device into the room and blow out the reheated supply air has been proposed. This reheating is performed with use of, for example, an electrothermal heater or a heating coil (part of a condenser). Further, the disclosure in Patent Literature 1 is to provide an air outlet device including a shutter configured to control the flow rate of the supply air to be blown out into the room, and a deflecting unit configured to guide the direction of the supply air. The air outlet device is connected to an air-conditioning duct. In Patent Literature 1, the shutter and the deflecting unit are adjusted to control the flow rate of the supply air for each supply-air outlet port, to thereby enhance the efficiency of air conditioning.

CITATION LIST

Patent Literature

Patent Literature 1: Japanese Unexamined Patent Application Publication No. 11-51456 (claim 1 and pages 3 to 4)

SUMMARY OF INVENTION

Technical Problem

However, the outside-air processing device having the reheating function uses the electrothermal heater, the heating coil, or other heating components, and hence power consumption is increased. Further, to achieve this reheating, valves, expansion valves, or other components are necessary, and thus the manufacturing cost is also increased. Further, the air outlet device disclosed in Patent Literature 1 requires components such as the shutter and the deflecting unit, and thus the number of components and the manufacturing cost are increased.

The present invention has been made in view of the above-mentioned problems. The present invention provides an outside-air processing device capable of enhancing the comfort of residents while minimizing increase in cost, and an air-conditioning apparatus including the outside-air processing device.

Solution to Problem

An outside-air processing device according to one embodiment of the present invention includes a main body having a return-air introducing port for introducing return air from a room and a supply-air outlet port for blowing out supply air into the room, a total heat exchanger arranged in the main body and configured to exchange heat between outdoor air and the return air, and to blow out the heat-exchanged outdoor air from the supply-air outlet port as the supply air, and an opening-closing unit configured to open and close a bypass path formed in the main body to bypass between the return-air introducing port and the supply-air outlet port.

Advantageous Effects of Invention

According to the one embodiment of the present invention, the bypass path is opened by the opening-closing unit, and the return air is introduced to the supply air through this bypass path. With this configuration, the comfort of the residents can be enhanced while the increase in cost is minimized.

DESCRIPTION OF EMBODIMENTS

Figure 1:
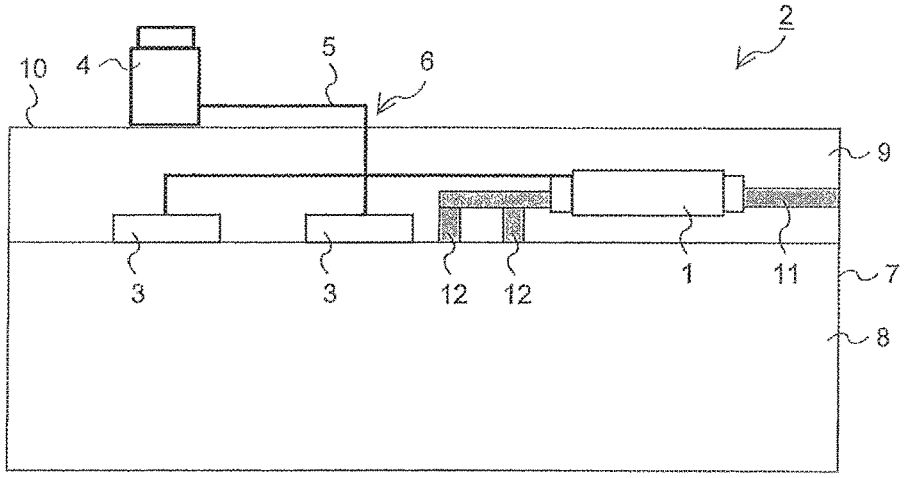
FIG. 1 is a schematic view for illustrating an air-conditioning apparatus 2 according to Embodiment 1 of the present invention.

An outside-air processing device and an air-conditioning apparatus according to embodiments of the present invention are described below with reference to the drawings. Note that, the present invention is not limited to the embodiments described below. Moreover, in the drawings referred to below including FIG. 1, the size relationship between components may be different from the reality.

Embodiment 1

FIG. 1 is a schematic view for illustrating an air-conditioning apparatus 2 according to Embodiment 1 of the present invention. With reference to FIG. 1, the air-conditioning apparatus 2 is described. The air-conditioning apparatus 2 includes an outside-air processing device 1, two indoor units 3, and one outdoor unit 4 that are connected to each other by pipes 5. Of those, the outside-air processing device 1 and the two indoor units 3 are installed in a space 9 above a ceiling of a building 7, and the outdoor unit 4 is installed on a rooftop 10 of the building 7. The outside-air processing device 1 is connected to the outside of the room through an outdoor duct 11, and is further connected to the inside of a room 8 through indoor ducts 12. A plurality of the outside-air processing devices 1 may be installed. Similarly, only one or a plurality of the indoor units 3 may be installed.

Figure 2:
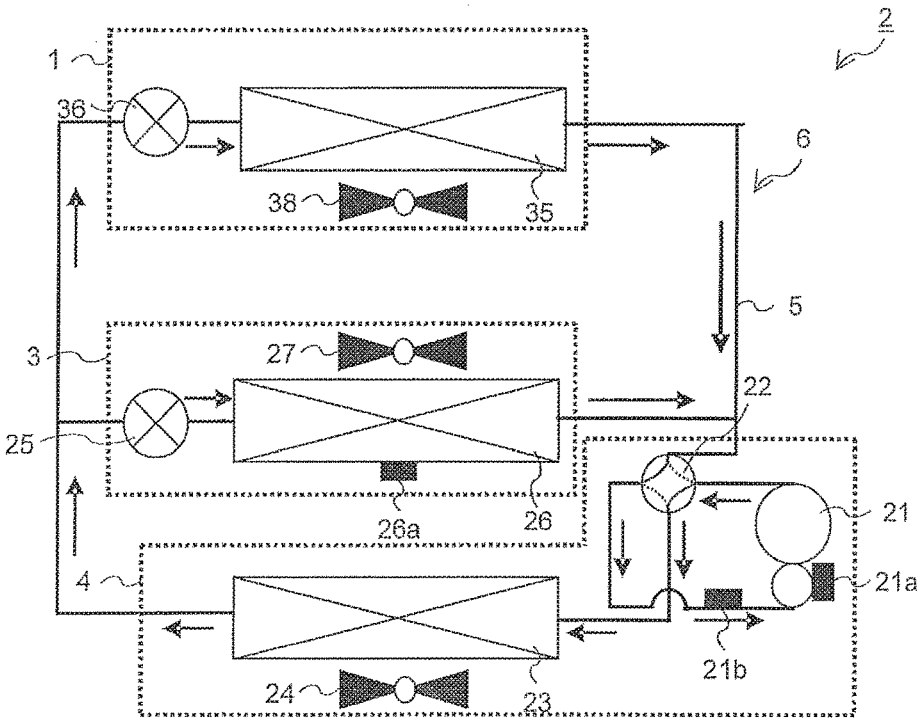
FIG. 2 is a schematic view for illustrating a refrigerant circuit 6 of the air-conditioning apparatus 2 according to Embodiment 1.

FIG. 2 is a schematic view for illustrating a refrigerant circuit 6 of the air-conditioning apparatus 2 according to Embodiment 1. As illustrated in FIG. 2, the outdoor unit 4 includes a compressor 21 configured to compress refrigerant, a four-way valve 22 configured to switch the flowing direction of the refrigerant, and an outdoor heat exchanger 23 configured to exchange heat between outdoor air and the refrigerant. Further, in the vicinity of the outdoor heat exchanger 23, an outdoor fan 24 is installed. This outdoor fan 24 is configured to supply the outdoor air to the outdoor heat exchanger 23. On the suction side of the compressor 21, a frequency adjusting unit 21*a* is provided. This frequency adjusting unit 21*a* is configured to adjust the frequency of the compressor 21. Further, on the suction side of the compressor 21, an evaporating temperature detecting unit 21*b* is provided. This evaporating temperature detecting unit 21*b* is configured to detect the evaporating temperature of the refrigerant flowing out from an indoor heat exchanger 26 or the outdoor heat exchanger 23.

Further, the indoor unit 3 includes an expansion unit 25 configured to expand the refrigerant, and the indoor heat exchanger 26 configured to exchange heat between return air and the refrigerant. Also in the vicinity of the indoor heat exchanger 26, an indoor fan 27 is installed. The indoor fan 27 is configured to supply the return air to the indoor heat exchanger 26. On the indoor heat exchanger 26, a suction temperature detecting unit 26*a* is provided. The suction temperature detecting unit 26*a* is configured to detect the temperature of the return air supplied by the indoor fan 27.

The outside-air processing device 1 includes an outside-air processing expansion unit 36 configured to expand the refrigerant, and an outside-air processing heat exchanger 35 configured to exchange heat between inflow air SAin and the refrigerant. In the vicinity of the outside-air processing device 1, a supply-air outlet fan 38 is installed. In the refrigerant circuit 6 of the air-conditioning apparatus 2, the outside-air processing expansion unit 36 and the outside-air processing heat exchanger 35 in the outside-air processing device 1 are connected in parallel to the expansion unit 25 and the indoor heat exchanger 26. As described above, in the refrigerant circuit 6 of the air-conditioning apparatus 2, the outside-air processing device 1, the compressor 21, the four-way valve 22, the outdoor heat exchanger 23, the expansion unit 25, and the indoor heat exchanger 26 are connected to each other by the pipes 5.

In the refrigerant circuit 6 of the air-conditioning apparatus 2, during a cooling operation, the refrigerant flows in the order of the compressor 21, the four-way valve 22, and the outdoor heat exchanger 23. Then, the refrigerant is branched so that the refrigerant flows in the order of the expansion unit 25 and the indoor heat exchanger 26 in the indoor unit 3, and flows in the order of the outside-air processing expansion unit 36 and the outside-air processing heat exchanger 35 in the outside-air processing device 1. Then, the streams of the refrigerant are joined to flow through the four-way valve 22 and to be sucked into the compressor 21.

Figure 3:
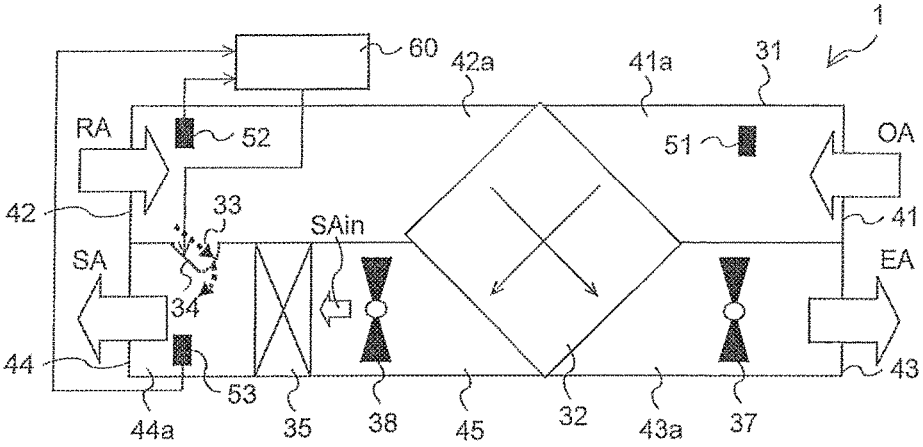
FIG. 3 is a schematic view for illustrating an outside-air processing device 1 according to Embodiment 1.

FIG. 3 is a schematic view for illustrating the outside-air processing device 1 according to Embodiment 1. As illustrated in FIG. 3, the outside-air processing device 1 is a ventilation device having a function of processing an outside-air load when the outside air is taken into the room 8, and includes a main body 31, a total heat exchanger 32 (upstream heat exchanger), an exhaust-air fan 37, the outside-air processing heat exchanger 35 (downstream heat exchanger), and the supply-air outlet fan 38.

The main body 31 has an outside-air introducing port 41, a return-air introducing port 42, an exhaust-air port 43, and a supply-air outlet port 44. The outside-air introducing port 41 is an opening for introducing outdoor air OA. The outdoor air OA introduced from the outside-air introducing port 41 passes through an outside-air path 41*a* through which the outdoor air OA flows, to thereby flow into the total heat exchanger 32. Further, the return-air introducing port 42 is an opening for introducing return air RA. The return air RA introduced from the return-air introducing port 42 passes through a return-air path 42*a* through which the return air RA flows, to thereby flow into the total heat exchanger 32. Those outside-air introducing port 41 and return-air introducing port 42 are opposed to each other.

Further, the exhaust-air port 43 is an opening for exhausting exhaust air EA. The return air RA heat-exchanged by the total heat exchanger 32 passes as the exhaust air EA through an exhaust-air path 43*a* through which the exhaust air EA flows, and is exhausted from the exhaust-air port 43. Further, the supply-air outlet port 44 is an opening for blowing out supply air SA. The outdoor air OA heat-exchanged by the total heat exchanger 32 passes as the inflow air SAin through an inflow path 45 through which the inflow air SAin flows, and further passes through the outside-air processing heat exchanger 35. Then, the air passes through a supply-air outlet path 44*a* through which the supply air SA flows, to thereby be blown out from the supply-air outlet port 44. Those exhaust-air port 43 and supply-air outlet port 44 are also opposed to each other. Further, the return-air path 42*a* through which the return air RA flows and the supply-air outlet path 44*a* through which the supply air SA flows are adjacent to each other.

The total heat exchanger 32 is arranged in the main body 31, and is configured to exchange heat between the outdoor air OA and the return air RA. The return air RA heat-exchanged by the total heat exchanger 32 is exhausted outside the room by the exhaust-air fan 37 as the exhaust air EA. Further, the outdoor air OA heat-exchanged by the total heat exchanger 32 flows into the outside-air processing heat exchanger 35 as the inflow air SAin. The outside-air processing heat exchanger 35 is configured to exchange heat between the inflow air SAin and the refrigerant in the refrigerant circuit 6. The heat-exchanged inflow air SAin is blown out into the room 8 by the supply-air outlet fan 38 as the supply air SA. As described above, the total heat exchanger 32 is arranged in the main body 31, and is configured to exchange heat between the outdoor air OA and the return air RA, to thereby blow out the heat-exchanged outdoor air OA from the supply-air outlet port 44 as the supply air SA.

The outside-air processing device 1 includes a return-air temperature detecting unit 52, a supply-air temperature detecting unit 53, and an outdoor-air temperature detecting unit 51. The return-air temperature detecting unit 52 is configured to detect a return-air temperature Tra of the return air RA, and is arranged in, for example, the return-air path 42*a* at the return-air introducing port 42 for introducing the return air RA. Further, the supply-air temperature detecting unit 53 is configured to detect a supply-air temperature Tsa of the supply air SA, and is arranged in, for example, the supply-air outlet path 44*a* at the supply-air outlet port 44 for blowing out the supply air SA. Further, the outdoor-air temperature detecting unit 51 is configured to detect a temperature of the outdoor air OA, and is arranged in, for example, the outside-air path 41*a* at the outside-air introducing port 41 for introducing the outdoor air OA.

In the main body 31, as described above, the return-air path 42*a* and the supply-air outlet path 44*a* are adjacent to each other, and are partially opened to form a bypass path 33. The bypass path 33 bypasses between the return-air introducing port 42 and the supply-air outlet port 44. Further, in the bypass path 33, an opening-closing unit 34 configured to open and close the bypass path 33 is provided. That is, the opening-closing unit 34 is configured to open and close the bypass path 33 formed in the main body 31 to bypass between the return-air introducing port 42 and the supply-air outlet port 44. When the bypass path 33 is opened by the opening-closing unit 34, part of the return air RA passes through the bypass path 33 to be mixed with the supply air SA in the supply-air outlet path 44*a*, and is blown out from the outside-air processing device 1. That is, the return air RA flowing through the bypass path 33 is mixed with the supply air SA heat-exchanged by the outside-air processing heat exchanger 35. Further, the opening-closing unit 34 is constructed of, for example, a damper. When the opening degree of the damper is adjusted, the flowing amount of the return air RA flowing through the bypass path 33 is adjusted, to thereby adjust the mixing ratio between the return air RA and the supply air SA.

Figure 4:
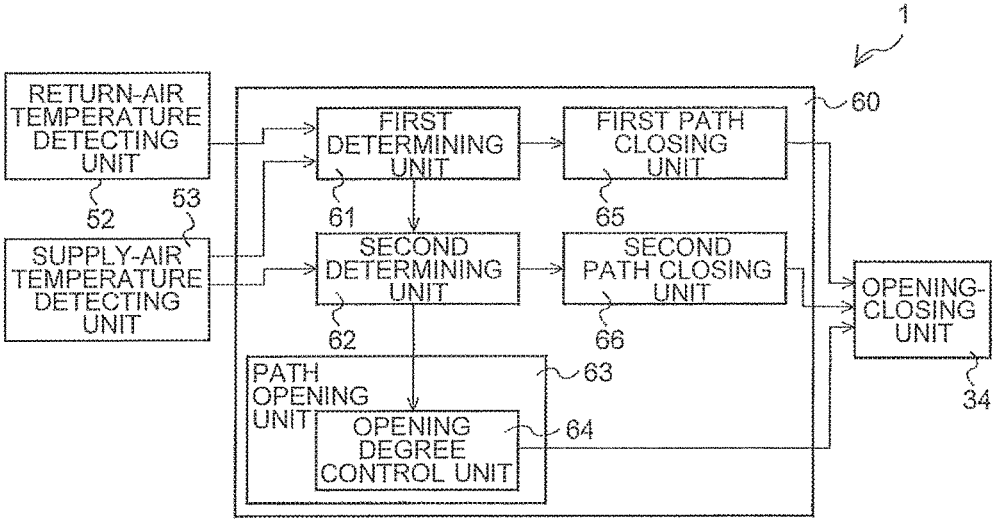
FIG. 4 is a block diagram for illustrating a control unit 60 according to Embodiment 1.

Further, the outside-air processing device 1 includes a control unit 60 configured to control the operation of the opening-closing unit 34 based on the return-air temperature Tra detected by the return-air temperature detecting unit 52 and the supply-air temperature Tsa detected by the supply-air temperature detecting unit 53. FIG. 4 is a block diagram for illustrating the control unit 60 according to Embodiment 1. As illustrated in FIG. 4, the control unit 60 includes a first determining unit 61, a second determining unit 62, a path opening unit 63, a first path closing unit 65, and a second path closing unit 66.

The first determining unit 61 is configured to determine whether or not the return-air temperature Tra detected by the return-air temperature detecting unit 52 is higher than the supply-air temperature Tsa detected by the supply-air temperature detecting unit 53. Further, the second determining unit 62 is configured to determine, when the first determining unit 61 determines that the return-air temperature Tra is higher than the supply-air temperature Tsa, whether or not the supply-air temperature Tsa detected by the supply-air temperature detecting unit 53 is lower than a predetermined threshold supply-air temperature Tsa_th. This threshold supply-air temperature Tsa_th is set to be decreased as a difference between a set supply-air temperature or set room temperature and the current actual room temperature inside the room 8 is increased. In this case, for example, the control unit 60 includes a table for storing the relationship between the threshold supply-air temperature Tsa_th and the difference between the set supply-air temperature or set room temperature and the actual room temperature, and the determination in the second determining unit 62 is made based on this table. Further, the threshold supply-air temperature Tsa_th can be set to be increased as time elapses.

Meanwhile, the first path closing unit 65 is configured to, when the first determining unit 61 determines that the return-air temperature Tra is equal to or lower than the supply-air temperature Tsa, control the opening-closing unit 34 to close the bypass path 33. Further, the second path closing unit 66 is configured to, when the second determining unit 62 determines that the supply-air temperature Tsa is equal to or higher than the threshold supply-air temperature Tsa_th, control the opening-closing unit 34 to close the bypass path 33.

The path opening unit 63 is configured to, when the second determining unit 62 determines that the supply-air temperature Tsa is lower than the threshold supply-air temperature Tsa_th, control the opening-closing unit 34 to open the bypass path 33. Further, the path opening unit 63 includes an opening degree control unit 64. The opening degree control unit 64 is configured to control the opening degree of the opening-closing unit 34 to adjust the flowing amount of the return air RA flowing through the bypass path 33, based on the difference obtained by subtracting the supply-air temperature Tsa from the threshold supply-air temperature Tsa_th. For example, the opening-closing unit 34 may be configured to increase the opening degree in proportion to this difference. In this case, when the threshold supply-air temperature Tsa_th is constant, the supply-air temperature Tsa is decreased as the difference is increased. At this time, the opening degree of the opening-closing unit 34 is increased to increase the flowing amount of the return air RA. Thus, the supply air SA is more heated.

Next, the operation in the refrigerant circuit 6 is described. First, the cooling operation is described. The compressor 21 sucks the refrigerant, compresses this refrigerant, and discharges the refrigerant in a high-temperature and high-pressure gas state. The discharged refrigerant passes through the four-way valve 22, and then flows into the outdoor heat exchanger 23. The outdoor heat exchanger 23 condenses the refrigerant through heat exchange with the outdoor air. The condensed refrigerant is branched into two directions. One stream of refrigerant flows into the indoor unit 3, and the other stream of refrigerant flows into the outside-air processing device 1. The refrigerant flowing into the indoor unit 3 first flows into the expansion unit 25 of the indoor unit 3, and the expansion unit 25 decompresses the condensed refrigerant. Then, the decompressed refrigerant flows into the indoor heat exchanger 26, and the indoor heat exchanger 26 evaporates the refrigerant through heat exchange with the return air supplied from the indoor fan 27. Subsequently, the room 8 is cooled.

Further, the refrigerant flowing into the outside-air processing device 1 first flows into the outside-air processing expansion unit 36 of the outside-air processing device 1, and the outside-air processing expansion unit 36 decompresses the condensed refrigerant. Then, the decompressed refrigerant flows into the outside-air processing heat exchanger 35, and the outside-air processing heat exchanger 35 evaporates the refrigerant through heat exchange with the inflow air SAin flowing through the outside-air processing device 1. Subsequently, the inflow air SAin is cooled to be blown out into the room 8 as the supply air SA. Then, the refrigerant evaporated in the indoor heat exchanger 26 and the refrigerant evaporated in the outside-air processing heat exchanger 35 are joined, and the joined streams of refrigerant pass through the four-way valve 22 to be sucked into the compressor 21.

Next, a heating operation is described. The compressor 21 sucks the refrigerant, compresses the refrigerant, and discharges the refrigerant in a high-temperature and high-pressure gas state. The discharged refrigerant passes through the four-way valve 22 to be branched into two directions. One stream of refrigerant flows into the indoor unit 3, and the other stream of refrigerant flows into the outside-air processing device 1. The refrigerant flowing into the indoor unit 3 first flows into the indoor heat exchanger 26 of the indoor unit 3, and the indoor heat exchanger 26 condenses the refrigerant through heat exchange with the return air supplied from the indoor fan 27. Subsequently, the room 8 is heated. Then, the condensed refrigerant flows into the expansion unit 25, and the expansion unit 25 decompresses the condensed refrigerant. Further, the refrigerant flowing into the outside-air processing device 1 first flows into the outside-air processing heat exchanger 35 of the outside-air processing device 1, and the outside-air processing heat exchanger 35 condenses the refrigerant through heat exchange with the inflow air SAin flowing through the outside-air processing device 1. Subsequently, the inflow air SAin is heated, and is blown out into the room 8 as the supply air SA. The refrigerant condensed in the outside-air processing heat exchanger 35 flows into the outside-air processing expansion unit 36, and the outside-air processing expansion unit 36 expands the condensed refrigerant.

Then, the refrigerant decompressed in the expansion unit 25 and the refrigerant decompressed in the outside-air processing expansion unit 36 are joined. The joined streams of refrigerant flow into the outdoor heat exchanger 23, and the outdoor heat exchanger 23 evaporates the refrigerant through heat exchange with the outdoor air. Then, the evaporated refrigerant passes through the four-way valve 22 to be sucked into the compressor 21.

Figure 5:
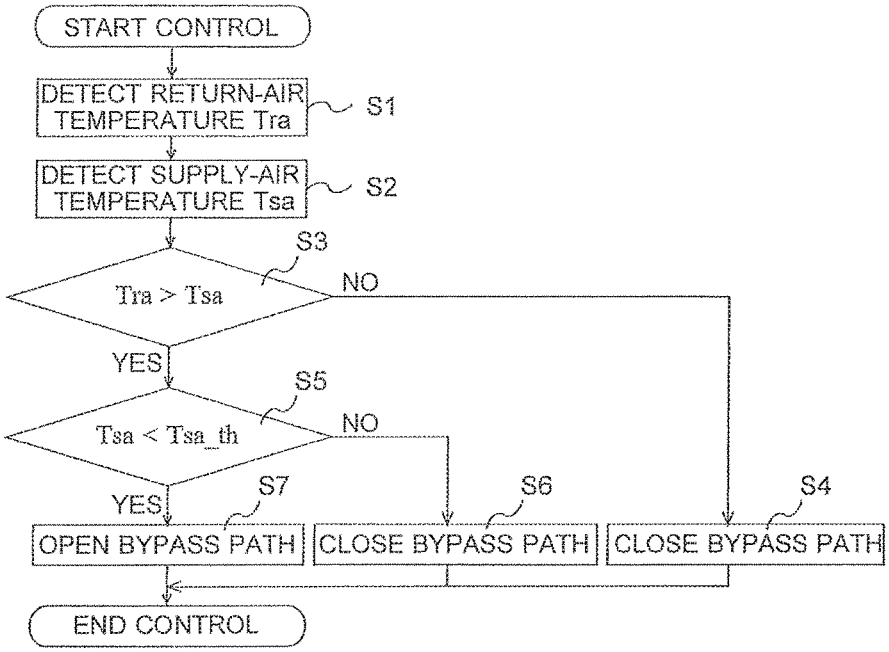
FIG. 5 is a flow chart for illustrating the operation of the outside-air processing device 1 according to Embodiment 1.

Next, the operation of the outside-air processing device 1 according to Embodiment 1 is described. FIG. 5 is a flow chart for illustrating the operation of the outside-air processing device 1 according to Embodiment 1. As illustrated in FIG. 5, after the control is started, first, the return-air temperature detecting unit 52 detects the return-air temperature Tra (Step S1). Then, the supply-air temperature detecting unit 53 detects the supply-air temperature Tsa (Step S2). Then, the first determining unit 61 determines whether or not the return-air temperature Tra detected by the return-air temperature detecting unit 52 is higher than the supply-air temperature Tsa detected by the supply-air temperature detecting unit 53 (Step S3). When the first determining unit 61 determines that the return-air temperature Tra is equal to or lower than the supply-air temperature Tsa (No in Step S3), the first path closing unit 65 controls the opening-closing unit 34 to close the bypass path 33 (Step S4). Then, the control is ended.

On the other hand, in Step S3, when the first determining unit 61 determines that the return-air temperature Tra is higher than the supply-air temperature Tsa (Yes in Step S3), the second determining unit 62 determines whether or not the supply-air temperature Tsa detected by the supply-air temperature detecting unit 53 is lower than the predetermined threshold supply-air temperature Tsa_th (Step S5). As described above, the threshold supply-air temperature Tsa_th is set to be decreased as the difference between the set supply-air temperature or set room temperature and the current actual room temperature inside the room 8 is increased. The threshold supply-air temperature Tsa_th can be set to be increased as time elapses. When the second determining unit 62 determines that the supply-air temperature Tsa is equal to or higher than the threshold supply-air temperature Tsa_th (No in Step S5), the second path closing unit 66 controls the opening-closing unit 34 to close the bypass path 33 (Step S6). Then, the control is ended.

On the other hand, in Step S5, when the second determining unit 62 determines that the supply-air temperature Tsa is lower than the threshold supply-air temperature Tsa_th (Yes in Step S5), the path opening unit 63 controls the opening-closing unit 34 to open the bypass path 33 (Step S7). The opening degree of the opening-closing unit 34 is controlled based on the difference obtained by subtracting the supply-air temperature Tsa from the threshold supply-air temperature Tsa_th. Then, the control is ended.

As described above, the outside-air processing device 1 according to Embodiment 1 is configured to open the bypass path 33 by the opening-closing unit 34, to thereby introduce the return air RA to the supply air SA through the bypass path 33. Subsequently, during the cooling operation, even when the supply air SA to be blown out from the outside-air processing device 1 into the room 8 is reduced in temperature, the supply air SA is heated by being mixed with the warm return air RA. Consequently, the supply air SA to be blown out into the room 8 is heated, and thus the comfort of the residents can be enhanced. Further, in Embodiment 1, to achieve this effect, a reheating function is not required to be added, and hence the increase in cost of the outside-air processing device 1 can be minimized.

Further, when the first determining unit 61 determines that the return-air temperature Tra is equal to or lower than the supply-air temperature Tsa, in Step S4, the first path closing unit 65 controls the opening-closing unit 34 to close the bypass path 33. When the return-air temperature Tra is equal to or lower than the supply-air temperature Tsa, even when the return air RA is mixed to the supply air SA, the supply air SA is cooled. In Embodiment 1, the first path closing unit 65 controls the opening-closing unit 34 to close the bypass path 33, and hence the cooling of the supply air SA can be prevented.

Further, when the second determining unit 62 determines that the supply-air temperature Tsa is equal to or higher than the threshold supply-air temperature Tsa_th, in Step S6, the second path closing unit 66 controls the opening-closing unit 34 to close the bypass path 33. Even when the return-air temperature Tra is higher than the supply-air temperature Tsa, as long as the supply-air temperature Tsa is equal to or higher than the threshold supply-air temperature Tsa_th, the supply air SA is not required to be heated. In Embodiment 1, the second path closing unit 66 controls the opening-closing unit 34 to close the bypass path 33, and hence excessive cooling of the supply air SA can be prevented.

The threshold supply-air temperature Tsa_th is set to be decreased as the difference between the set supply-air temperature or set room temperature and the current actual room temperature inside the room 8 is increased. For example, when the actual room temperature inside the room 8 is high as in summer, to immediately cool the room 8, the set supply-air temperature or set room temperature is set to be low. Consequently, the difference between the set supply-air temperature or set room temperature and the current actual room temperature inside the room 8 is increased. Subsequently, the threshold supply-air temperature Tsa_th is set to be low, and thus the second determining unit 62 tends to determine that the supply-air temperature Tsa is equal to or higher than the threshold supply-air temperature Tsa_th. Consequently, the second path closing unit 66 tends to control the opening-closing unit 34 to close the bypass path 33, and thus the supply air SA is not heated. Subsequently, the supply air SA remains cold, and when the room temperature inside the room 8 is high as described below, the room 8 can be immediately cooled. Subsequently, the load at the time of activation can be reduced, and hence energy can be saved.

Still further, when the second determining unit 62 determines that the supply-air temperature Tsa is lower than the threshold supply-air temperature Tsa_th, in Step S7, the path opening unit 63 controls the opening-closing unit 34 to open the bypass path 33. When the return-air temperature Tra is higher than the supply-air temperature Tsa, and when the supply-air temperature Tsa is lower than the threshold supply-air temperature Tsa_th, the supply air SA is required to be heated. In Embodiment 1, the path opening unit 63 controls the opening-closing unit 34 to open the bypass path 33. Consequently, the return air RA is mixed to the supply air SA, and thus the supply air SA is heated. Consequently, the supply air SA to be blown out into the room 8 is heated, and thus the comfort of the residents can be enhanced.

Embodiment 2

Figure 6:
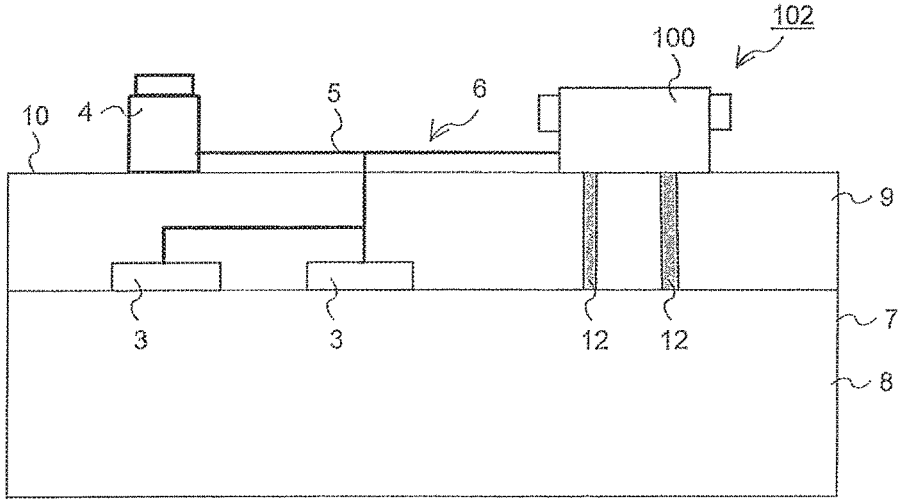
FIG. 6 is a schematic view for illustrating an air-conditioning apparatus 102 according to Embodiment 2 of the present invention.

Next, an air-conditioning apparatus 102 according to Embodiment 2 of the present invention is described. FIG. 6 is a schematic view for illustrating the air-conditioning apparatus 102 according to Embodiment 2. Embodiment 2 differs from Embodiment 1 in that an outside-air processing device 100 is installed on the rooftop 10 of the building 7. In Embodiment 2, parts common to Embodiment 1 are denoted by the same reference signs, and the descriptions of the common parts are omitted. Differences from Embodiment 1 are mainly described.

In Embodiment 2, as illustrated in FIG. 6, the outside-air processing device 100 is installed on the rooftop 10 of the building 7. Further, the outside-air processing device 100 is connected to the room 8 through the two indoor ducts 12. With this configuration, the return air RA is introduced and the supply air SA is blown out. Further, the outside-air processing device 100 is directly connected to the outside of the room without using the outdoor duct 11. The outside-air processing device 100 according to Embodiment 2 has effects similar to those of Embodiment 1.

Embodiment 3

Figure 7:
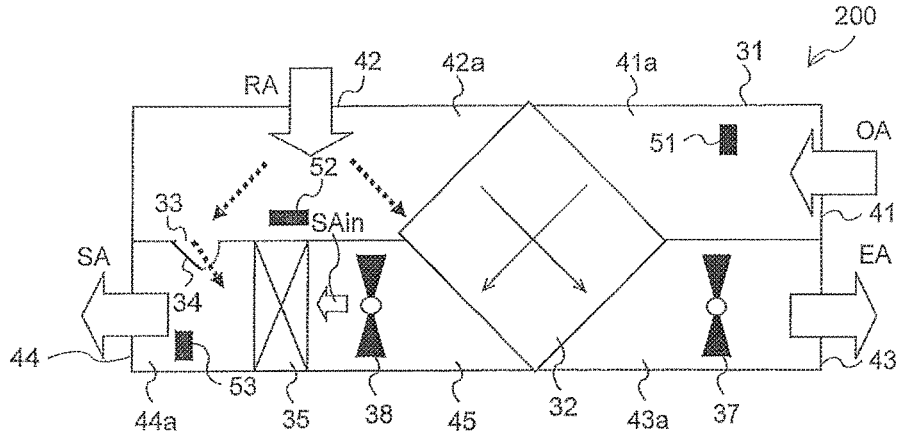
FIG. 7 is a schematic view for illustrating an outside-air processing device 200 according to Embodiment 3 of the present invention.

Next, an air-conditioning apparatus 202 according to Embodiment 3 of the present invention is described. FIG. 7 is a schematic view for illustrating an outside-air processing device 200 according to Embodiment 3. Embodiment 3 differs from Embodiment 1 in the position at which the return-air introducing port 42 is formed in the main body 31. In Embodiment 3, parts common to Embodiment 1 are denoted by the same reference signs, and the descriptions of the common parts are omitted. Differences from Embodiment 1 are mainly described.

In Embodiment 3, as illustrated in FIG. 7, the return-air introducing port 42 is formed at a position opposed to the bypass path 33 in the main body 31. With this configuration, when the bypass path 33 is opened, the return air RA is easily guided to the bypass path 33. Consequently, such an effect that the supply air SA is easily heated by the return air RA is provided. The position at which the return-air introducing port 42 is formed can be appropriately changed. Further, in FIG. 7, the return-air introducing port 42 is formed so that the direction in which the outdoor air OA flows and the direction in which the return air RA flows are perpendicular to each other. When the outside-air processing device is installed on the rooftop 10 of the building 7 similarly to the outside-air processing device 100 according to Embodiment 2, the return-air introducing port 42 formed as described above is particularly effective because the outside-air processing device is easily connected to the inside of the room 8.

Embodiment 4

Figure 8:
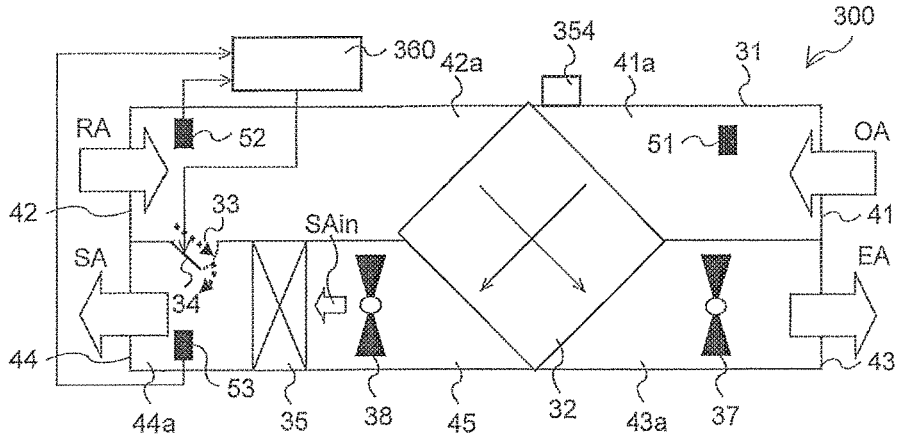
FIG. 8 is a schematic view for illustrating an outside-air processing device 300 according to Embodiment 4 of the present invention.

Next, an air-conditioning apparatus 302 according to Embodiment 4 of the present invention is described. FIG. 8 is a schematic view for illustrating an outside-air processing device 300 according to Embodiment 4. Embodiment 4 differs from Embodiment 1 in that a human detecting unit 354 is provided, and further differs from Embodiment 1 in a configuration of a control unit 360. In Embodiment 4, parts common to Embodiment 1 are denoted by the same reference signs, and the descriptions of the common parts are omitted. Differences from Embodiment 1 are mainly described.

Figure 9:
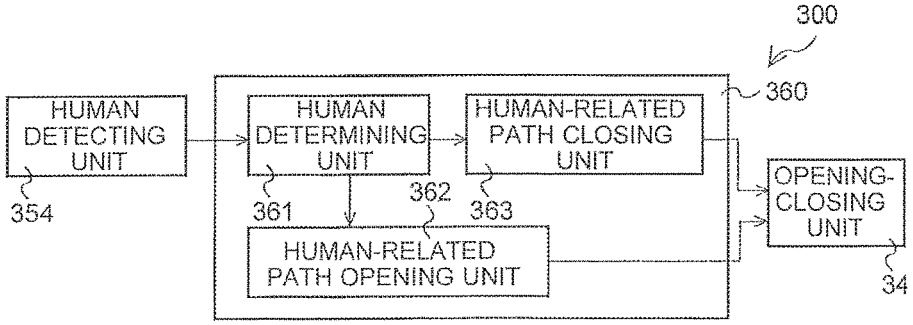
FIG. 9 is a block diagram for illustrating a control unit 360 according to Embodiment 4.

As illustrated in FIG. 8, the outside-air processing device 300 includes the human detecting unit 354 configured to detect the presence or absence of a human. FIG. 9 is a block diagram for illustrating the control unit 360 according to Embodiment 4. As illustrated in FIG. 9, the control unit 360 includes a human determining unit 361, a human-related path closing unit 363, and a human-related path opening unit 362. The human determining unit 361 is configured to determine whether or not a human is detected by the human detecting unit 354. Further, when the human determining unit 361 determines that no human is present, the human-related path closing unit 363 controls the opening-closing unit 34 to close the bypass path 33. Further, when the human determining unit 361 determines that a human is present, the human-related path opening unit 362 controls the opening-closing unit 34 to open the bypass path 33.

Figure 10:
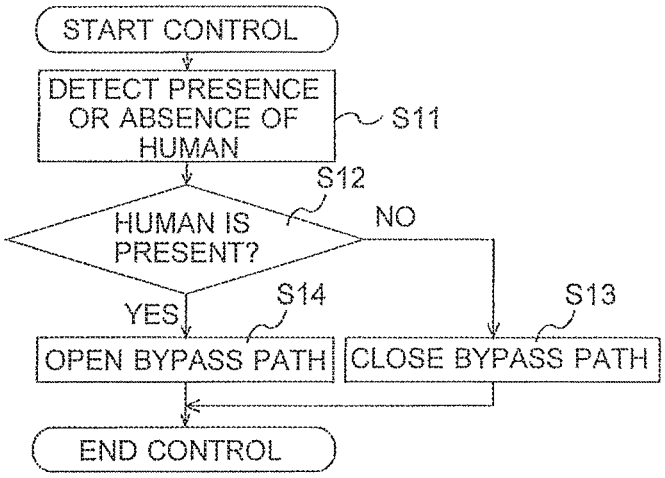
FIG. 10 is a flow chart for illustrating the operation of the outside-air processing device 300 according to Embodiment 4.

Next, the operation of the outside-air processing device 300 according to Embodiment 4 is described. FIG. 10 is a flow chart for illustrating the operation of the outside-air processing device 300 according to Embodiment 4. As illustrated in FIG. 10, after the control is started, first, the human detecting unit 354 detects the presence or absence of a human (Step S11). Then, the human determining unit 361 determines whether or not a human is detected by the human detecting unit 354 (Step S12). When the human determining unit 361 determines that no human is present (No in Step S12), the human-related path closing unit 363 controls the opening-closing unit 34 to close the bypass path 3 (Step S13). Then, the control is ended.

Meanwhile, in Step S12, when the human determining unit 361 determines that a human is present (Yes in Step S12), the human-related path opening unit 362 controls the opening-closing unit 34 to open the bypass path 33 (Step S14). Then, the control is ended.

As described above, in the outside-air processing device 300 according to Embodiment 4, when the human determining unit 361 determines that no human is present, in Step S13, the human-related path closing unit 363 controls the opening-closing unit 34 to close the bypass path 33. In a region in which no human is present, the supply air SA is not required to be heated. In Embodiment 4, the human-related path closing unit 363 controls the opening-closing unit 34 to close the bypass path 33, and hence needless cooling of the supply air SA can be prevented.

Further, when the human determining unit 361 determines that a human is present, in Step S14, the human-related path opening unit 362 controls the opening-closing unit 34 to open the bypass path 33. Subsequently, in a region in which a human is present, the heated supply air SA by being mixed with the return air RA is blown out. Consequently, the comfort of the residents can be enhanced.

The outside-air processing device can be obtained by combining the configurations of Embodiments 1 to 3 with the configuration of Embodiment 4.

REFERENCE SIGNS LIST

1 outside-air processing device 2 air-conditioning apparatus 3 indoor unit 4 outdoor unit 5 pipe 6 refrigerant circuit 7 building 8 room 9 space above ceiling 10 rooftop 11 outdoor duct 12 indoor duct 21 compressor 21*a* frequency adjusting unit 21*b* evaporating temperature detecting unit 22 four-way valve 23 outdoor heat exchanger 24 outdoor fan 25 expansion unit 26 indoor heat exchanger 26*a* suction temperature detecting unit 27 indoor fan main body 32 total heat exchanger 33 bypass path 34 opening-closing unit 35 outside-air processing heat exchanger 36 outside-air processing expansion unit 37 exhaust-air fan 38 supply-air outlet fan 41 outside-air introducing port 41*a* outside-air path 42 return-air introducing port 42*a* return-air path 43 exhaust-air port 43*a* exhaust-air path 44 supply-air outlet port 44*a* supply-air outlet path 45 inflow path 51 outdoor-air temperature detecting unit 52 return-air temperature detecting unit 53 supply-air temperature detecting unit 60 control unit 61 first determining unit 62 second determining unit 63 path opening unit 64 opening degree control unit 65 first path closing unit 66 second path closing unit 100 outside-air processing device 102 air-conditioning apparatus 200 outside-air processing device 202 air-conditioning apparatus 300 outside-air processing device 302 air-conditioning apparatus 354 human detecting unit 360 control unit 361 human determining unit 362 human-related path opening unit 363 human-related path closing unit

The invention claimed is:

1. An outside-air processing device, comprising:

a main body having a return-air introducing port for introducing return air from a room into the main body and a supply-air outlet port for blowing out supply air from the main body into the room;

a total heat exchanger arranged in the main body and configured to exchange heat between outdoor air and the return air, and to introduce the heat-exchanged outdoor air from the supply-air outlet port as the supply air;

a return-air path through which the return air flows;

a supply-air outlet path through which the supply air flows;

a bypass path formed in the main body to communicate the return-air path and the supply-air outlet path;

a damper configured to open and close the bypass path;

a return-air temperature detector configured to detect a return-air temperature of the return air;

a supply-air temperature detector configured to detect a supply-air temperature of the supply air; and a controller configured to cause the damper to open or close based on the return-air temperature detected by the return-air temperature detector and the supply-air temperature detected by the supply-air temperature detector, wherein the controller is further configured to determine whether or not the return-air temperature detected by the return-air temperature detector is higher than the supply-air temperature detected by the supply-air temperature detector, in response to a determination that the return-air temperature is higher than the supply-air temperature, determine whether or not the supply-air temperature is lower than a predetermined threshold supply-air temperature, and in response to a determination that the supply-air temperature is lower than the predetermined threshold supply-air temperature, cause the damper to open the bypass path.

2. The outside-air processing device of claim 1, wherein the return-air path and the supply-air outlet path are adjacent to each other.

3. The outside-air processing device of claim 1, wherein the return-air introducing port is formed in the main body at a position opposed to the bypass path.

4. The outside-air processing device of claim 1, wherein the controller is further configured to, in response to a determination that the return-air temperature is equal to or lower than the supply-air temperature, cause the damper to close the bypass path.

5. The outside-air processing device of claim 1, wherein the controller is further configured to, in response to a determination that the supply-air temperature is equal to or higher than the predetermined threshold supply-air temperature, cause the damper to close the bypass path.

6. The outside-air processing device of claim 1, wherein the controller is further configured to control an opening degree of the damper to adjust a flowing amount of the return air flowing through the bypass path, based on a difference obtained by subtracting the supply-air temperature from the predetermined threshold supply-air temperature.

7. The outside-air processing device of claim 1, wherein the predetermined threshold supply-air temperature is set to be decreased as a difference between a set supply-air temperature or a set room temperature and an actual room temperature inside the room is increased.

8. The outside-air processing device of claim 1, wherein the controller is further configured to determine whether or not a human is detected, and in response to a determination that no human is present, cause the damper to close the bypass path, and in response to a determination that a human is present, cause the damper to open the bypass path.

9. The outside-air processing device of claim 1, further comprising:

an outside-air processing heat exchanger configured to exchange heat between refrigerant and the outdoor air heat-exchanged by the total heat exchanger and to introduce the air heat-exchanged by the outside-air processing heat exchanger to the supply-air outlet port as the supply air, the return air flowing through the bypass path being mixed with the supply air after the supply air is heat-exchanged by the outside-air processing heat exchanger.

10. An air-conditioning apparatus, comprising a refrigerant circuit connecting, by a pipe, the outside-air processing device of claim 9, a compressor, an outdoor heat exchanger, an expansion unit, and an indoor heat exchanger.

11. The outside-air processing device of claim 9, further comprising an outside-air processing expansion unit configured to expand the refrigerant.

* * * * *